United States Patent [19]

Bruce

[11] 4,206,929

[45] Jun. 10, 1980

[54] BLOW OUT PREVENTER

[76] Inventor: Albert I. Bruce, 1221-45th Ave. NE., Calgary, Alberta, Canada

[21] Appl. No.: 884,171

[22] Filed: Mar. 7, 1978

[51] Int. Cl.[2] ..... E21B 33/06

[52] U.S. Cl. ..... 277/34; 15/104.04; 251/1 B; 251/5

[58] Field of Search ..... 251/1 B, 4–10, 251/61.1; 277/34, 71; 166/84, 86, 88, 82; 285/97

[56] References Cited

U.S. PATENT DOCUMENTS

| | | | |
|---|---|---|---|
| 2,071,197 | 2/1937 | Burns et al. | 277/34 |
| 2,188,557 | 1/1940 | Otis | 166/88 |
| 2,193,587 | 3/1940 | Fortune et al. | 277/34 |
| 3,939,910 | 2/1976 | Bruce | 166/84 |

*Primary Examiner*—Martin P. Schwadron
*Assistant Examiner*—Richard Gerard
*Attorney, Agent, or Firm*—Stanley G. Ade

[57] ABSTRACT

In oil and gas well pumping apparatus, a polish rod reciprocates through a stuffing box and connects to a submersible pump through a tubing string or the like. When servicing, it is desirable to close off the gas or oil pressure from below and hydraulic fluid is routed from a remote location to the blow out preventer. The blow out preventer consists of a cylindrical casing with a cap screw threadably engaged to the upper end thereof and containing a cylindrical spool or the like formed from elastomeric material having an annular channel around the outer perimeter which is operatively connected to the source of hydraulic fluid. When it is desired to close off the blow out preventer, hydraulic fluid is pumped under pressure to the channel thus forcing the center of the spool inwardly and clamping same around the polish rod thereby closing off the passageway around the polish rod. O rings surround the spool above and below the channel and assist in sealing. Upper and lower steps in the casing slope outwardly and away from one another to facilitate the return of the spool to the normal position when pressure is released.

2 Claims, 2 Drawing Figures

BLOW OUT PREVENTER

BACKGROUND OF THE INVENTION

This invention relates to new and useful improvements in blow out preventers, specifically designed for use with oil and gas pumping apparatus in which a polish rod connected to a pump string, reciprocates by means of a source of power.

The blow out preventer is used to close off any pressure from the tubing string that may cause a blow out of the well through the tubing, thus permitting servicing to be undertaken.

Conventionally, a blow out preventer is closed manually by an operator approaching the blow out preventer and actuating same. This is relatively dangerous with a well that is leaking oil or gas inasmuch as the operator may often come in contact with poisonous fumes of the well when attempting to close off same.

Conventional blow out preventers often leak themselves and when releasing same, the clamping element often remains adhered to or in contact with the polish rod so that damage occurs when the well is re-started.

SUMMARY OF THE INVENTION

This invention overcomes disadvantages inherent with conventional blow out preventers firstly by providing means whereby it can, if desired, be operated remotely and secondly, by providing a blow out preventer which in itself does not leak and which includes means to ensure the effective withdrawal of the blow out element from the polish rod.

One aspect of the invention comprises a casing engageable between upper and lower tubing sections, a screw threaded cap detachably engaged upon one end of said casing, one of said tubing sections being operatively secured within said cap, a resilient cylindrical spool within said casing, means within said casing to position said spool, an annular channel formed around the outside of said spool intermediate the ends thereof, means operatively connecting through said casing with said channel and being operatively connected to said source of hydraulic fluid under pressure whereby said spool is caused to collapse inwardly upon the associated polish rod by said hydraulic fluid.

Another object of the invention is to provide a device which is easily situated within the oil or gas tubing through which the polish rod reciprocates.

A still further object of the invention is to provide a device of the character herewithin described which is simple in construction, economical in manufacture and otherwise well suited to the purpose for which it is designed.

With the foregoing and other such advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 1:
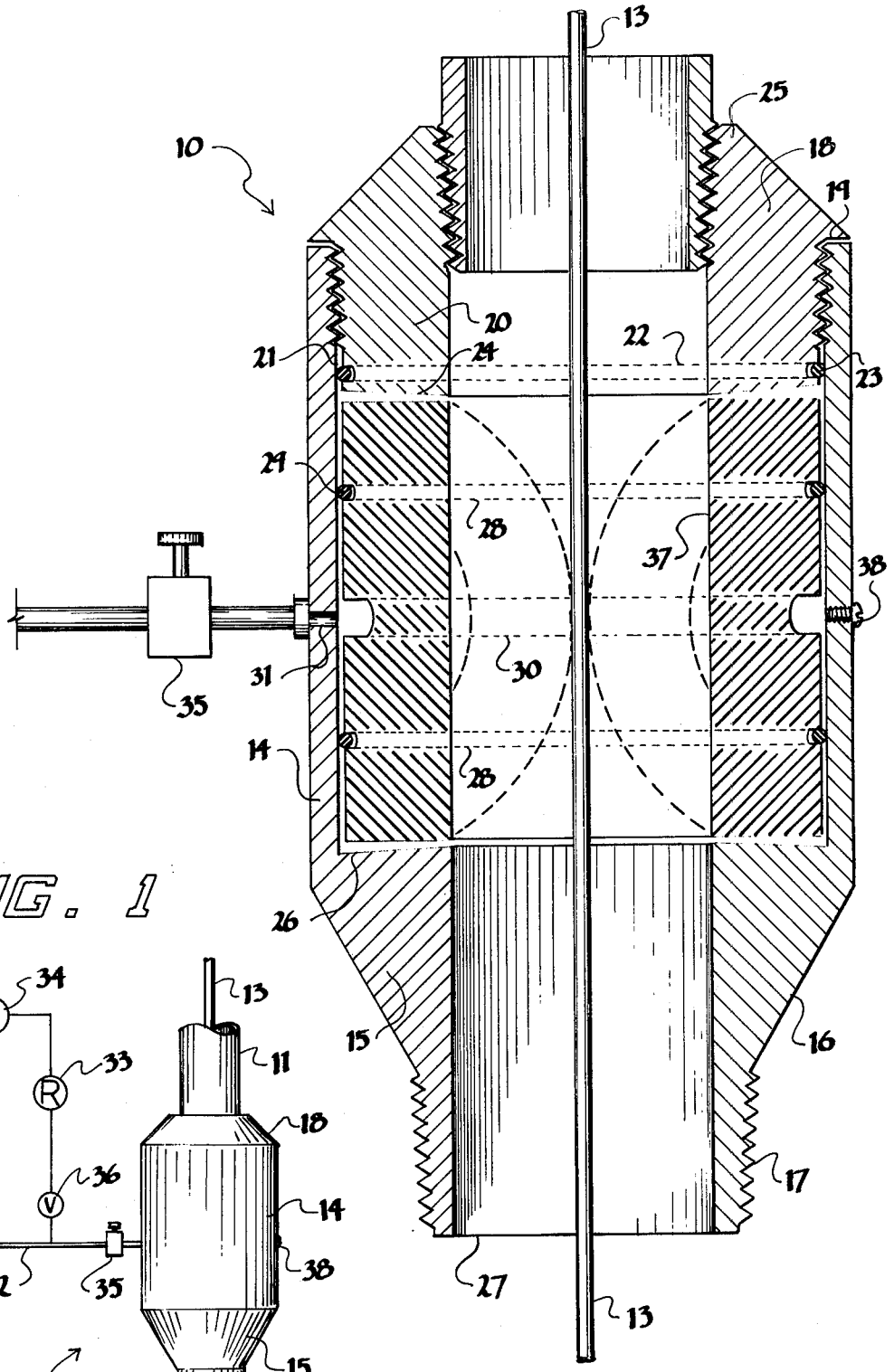
FIG. 1 is an elevational view of the device situated between adjacent sections of tubing.

Proceeding therefore to describe the invention in detail, reference character 10 illustrates the blow out preventer which may be situated in any desired location between upper and lower tubing sections 11 and 12, depending upon design parameters.

A conventional polish rod 13 reciprocates through the tubing sections 11 and 12 and through the blow out preventer 10, being operated in the usual way (not illustrated).

The blow out preventer 10 comprises a relatively heavy gauge steel cylinder 11 having, in this embodiment, a formed in place lower end portion which tapers inwardly as shown by reference character 16 and terminates with a screw threaded lower end 17 screw threadably engageable within the lower tubing section 12 in the usual manner.

Alternatively, the lower end may be formed separately and screw threadably engaged within the lower end of the cylinder 12.

A heavy gauge steel cap 18 is shouldered as at 19 and includes the inner cylindrical portion 20 which is externally screw threaded and adapted to screw threadably engage within the upper end of the casing 14. In this respect, the inner end portion 21 of the portion 20 is without screw threads and is provided with an annular groove 22 around which a resilient O ring 23 engages thus assisting in the sealing relationship of the cap 18 with the cylinder 14.

It will be observed that the inner face 24 of this cap slopes outwardly and towards the outer end 25 of the cap, the purpose of which will be hereinafter described.

A shoulder 26 is formed on the lower end portion 15 where it extends from the lower end of the cylindrical casing 14 and this shoulder also slopes outwardly and towards the lower end 27 of the portion 15.

Figure 2:
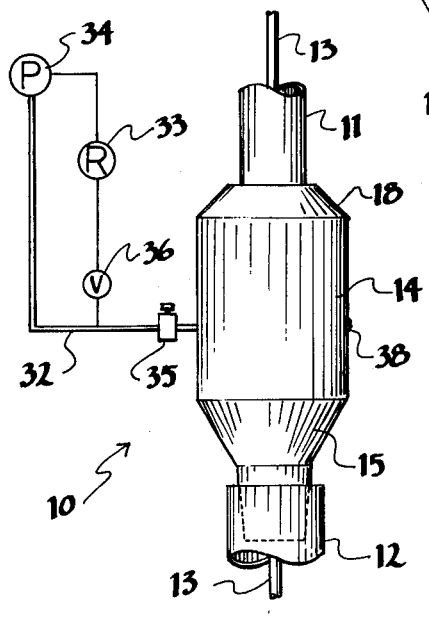
FIG. 2 is an enlarged partially sectioned view of the blow out preventer per se.

A cylindrical spool 28 is formed of a resilient elastomeric material such as a urethane rubber compound or the like and engages within the casing 14, being positioned by the aforementioned shoulder 26 insofar as the lower end is concerned and by the inner surface 24 of the end cap 18, after it is installed as clearly shown in FIG. 2.

Upper and lower annular grooves 28 are formed around the outer perimeter of this spool and sealing O rings 29 engage within these grooves and sealably engage the inner surface of the casing 14.

An annular channel 30 is formed around the outer perimeter of the spool 28 intermediate the ends and between the grooves 28, and when the spool is installed within the casing 14, this annular channel 30 aligns with a drilling 31 formed through the wall of the casing 14. A conduit 32 is operatively secured to this drilling 31 and extends to a source of hydraulic fluid within a reservoir 33 and a pump 34. A control valve 35 is also present within the conduit together with a one-way return valve 36 between the conduit 32 and the reservoir 33.

In operation, the spool is normally in the position shown in solid line in FIG. 2, whereupon the polish rod 13 may reciprocate in the usual way.

However, when it is desirable to close off the well for servicing or repair, hydraulic fluid under pressure is routed to the channel 30 by opening valve 35, thus collapsing the spool inwardly as shown in phantom in FIG. 2 so that the inner surfaces 37 clamp around the polish rod 13 within the casing 14 thus sealing off the area below the spool from the area above. In other words, the well is effectively closed off by this clamping action of the spool around the polish rod. An air bleed screw 38 is provided through the wall of the casing, for initial air bleeding when the device is first installed.

With the spool in the position shown in phantom, the upper end lower surfaces tend to move in the opposite directions to the sloping surfaces 24 and 26.

When it is desired to release the spool from the polish rod, the pump 34 is closed and valve 36 is opened thus allowing the hydraulic fluid to release to the reservoir 33.

The inherent resiliency of the spool retracts the inner wall 37 from the polish rod and any tendency for this retraction to be restricted, is counteracted by the provision of the sloping walls 24 and 26 which allows plenty of room for the retraction of the spool.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A blow out preventer for use in oil and gas well pumping assemblies which includes a polish rod, upper and lower tubing sections within which said polish rod reciprocates and a source of hydraulic fluid under pressure; comprising in combination a casing engageable between said upper and lower tubing sections, a cap detachably securable upon one end of said casing, one of said tubing sections being operatively secured within said cap, a resilient cylindrical spool within said casing, said spool having end walls perpendicular to the longitudinal axis of said spool, means within said casing to position said spool, said means to position said spool within said casing including a spool engaging inner end on said cap and a spool engaging shoulder formed within said casing adjacent the end thereof opposite to said cap, an annular channel formed around the outside of said spool intermediate the ends thereof, means operatively connecting through said casing with said channel and being operatively connected to said source of hydraulic fluid under pressure whereby said spool is caused to collapse inwardly upon the associated polish rod by said hydraulic fluid, said inner end of said cap slopping outwardly and towards the outer end of said cap, said shoulder sloping outwards and towards said end of said casing opposite to said cap, said sloping inner end and sloping shoulder defining with the end walls of said spool, an annular wedge-shaped space when said spool is in a non-collapsed position, thereby facilitating the return of said spool from the collapsed position.

2. The invention according to claim 1 which includes an O ring seal around said spool above and below said channel and sealably engaging the inner wall of said casing.

* * * * *